United States Patent [19]

Bartels et al.

[11] 4,115,220

[45] Sep. 19, 1978

[54] PROCESS FOR THE PREPARATION OF HIGH PURITY ANTIMONY

[75] Inventors: Günter Bartels, Wildemann; Horst Immenroth, Langelsheim; Günter Heyer, Goslar, all of Fed. Rep. of Germany

[73] Assignee: Preussag Aktiengesellschaft Metall, Goslar, Fed. Rep. of Germany

[21] Appl. No.: 844,836

[22] Filed: Oct. 25, 1977

[30] Foreign Application Priority Data

Apr. 5, 1977 [DE] Fed. Rep. of Germany ..... 2715150

[51] Int. Cl.[2] ..... C25C 1/22

[52] U.S. Cl. ..... 204/105 R

[58] Field of Search ..... 204/105 R

[56] References Cited

U.S. PATENT DOCUMENTS 3,723,267 3/1973 Baiborodov et al. ..... 204/105 R

FOREIGN PATENT DOCUMENTS 208,953 2/1967 U.S.S.R. ..... 204/105

*Primary Examiner*—R. L. Andrews

*Attorney, Agent, or Firm*—Toren, McGeady and Stanger

[57] ABSTRACT

A method for production of high purity antimony by producing antimony(III) oxide from hydrolysis of antimony chloride, dissolving the antimony(III) oxide in a solution containing d-sorbitol and a base, and electrolyzing the solution using insoluble electrodes.

6 Claims, No Drawings

PROCESS FOR THE PREPARATION OF HIGH PURITY ANTIMONY

BACKGROUND OF THE INVENTION

1. Field of the Invention

The invention relates to a process for the preparation of antimony of high purity in which the antimony (III) oxide is dissolved in an aqueous alkaline solution and the solution is subjected to electrolysis.

2. Description of the Prior Art

Antimony of high purity is required for antimony alloys, for use as semiconductors. A process for the preparation of antimony of high purity of the type mentioned at the beginning is disclosed in German Offenlegungsschrift No. 2,063,307. This process starts with antimony(III) oxide which is obtained by burning refined metal and which is treated with dilute nitric acid with stirring, before it is dissolved in an aqueous, alkaline solution of glycerine and sodium hydroxide. After allowing the mixture to settle, the solution is drawn off and the undissolved antimony(III) oxide is washed with water. The solution with the dissolved antimony(III) oxide is electrolyzed using pure graphite as the anode and antimony of a high degree of purity as the cathode.

The efficiency of this process is relatively poor since the electrolysis can only be carried out till the electrolyte content decreases to 60 to 80 g Sb/l electrolyte. Then, the electrolyte must be concentrated again to 100 g Sb/l. A further significant disadvantage of this process is due to the dissolution of the graphite anodes after a short period of electrolysis. As a consequence, finely divided carbon is produced and is essentially distributed throughout the electrolyte. In order to prevent a deposition of this carbon together with the antimony, an additional filtration of the electrolyte is necessary which step is quite costly. Moreover, high costs also result from the high consumption of the graphite anodes.

SUMMARY OF THE INVENTION

The present invention provides a process for the preparation of antimony of high purity for use in semiconductors by means of which the previously mentioned disadvantages can be avoided. Specifically, the present process provides a simplified process which is more effective than the prior art process wherein a non-dissolving anode is used and wherein the usable concentration range of dissolved antimony oxide in the electrolyte is considerably greater so that the electrolysis process need not be cut short due to too low an electrolyte concentration.

This is accomplished by hydrolyzing distilled antimony(III) chloride with ammonium hydroxide and dissolving the antimony(III) oxide which precipitates during the hydrolysis in an aqueous solution containing d-sorbitol and a base, e.g., sodium hydroxide, and then, electrolyzing the solution using insoluble anodes.

DESCRIPTION OF THE PREFERRED EMBODIMENT

Preferably, as electrodes, a titanium metal mesh, coated with platinum, is used as the anode in this process while the antimony is deposited on a tantalum cathode. In a further advantageous variation of the inventive process, the antimony is precipitated from a solution that contains from about 220 to 270 g sorbitol per liter, about 80 to 100 g/l of sodium hydroxide and about 130 to 150 g/l of antimony at the beginning of the electrolysis. It has turned out to be advantageous in this process to precipitate the antimony at a current voltage of from about 3 to 5 V, a cathode current density of about 150 to 400 amps/m$^2$ and a bath temperature of about 30° to 50° C onto a cathode that is arranged at a distance of about 25 mm from the cathode.

In the inventive process, the solution containing d-sorbitol and sodium hydroxide can be heated to a temperature of about 40° to 70° C. The antimony(III) oxide that has not gone into solution can then be filtered out and the solution circulated by pumping during the electrolysis. Furthermore, the solution is preferably electrolyzed until the concentration of antimony reaches 40 g per liter. When the bath reaches this lower limit, 1 to 3 volume percent of the bath is replaced by fresh solution so that any undesirable enrichment of the bath with impurities, such as, arsenic, is avoided.

The advantages of the inventive process for the preparation of antimony of high purity is apparent since the efficiency is improved by a simple means and the range of concentration of dissolved antimony between the commencement and the end of the electrolysis is considerably greater with 90 to 100 g Sb/l so that less frequent interruptions of the electrolysis are required for increasing the concentration. Another advantage is that there is no evidence of corrosion at the electrodes.

Moreover, there are no losses and therefore, no costs due to dissolving of the anodes. Even if the concentration of electrolytes is increased more frequently, the losses of d-sorbitol and sodium hydroxide are slight. Thus, the present process is economically more advantageous than the prior art process.

The following example further explains the present invention. Doubly distilled antimony(III) chloride was hydrolyzed with ammonium hydroxide. An amount of 26 kg antimony(III) oxide produced from this hydrolysis was treated further as follows:

100 g per liter of sodium hydroxide and 200 g per liter of d-sorbitol were dissolved in 150 l of water. The solution was heated to about 60° C, the antimony(III) oxide was dissolved in it and the undissolved antimony(III) oxide filtered off. The filtered, light brown solution then had an antimony content of 140 g/l.

The solution was electrolyzed in an electrolysis cell made from hard polyvinyl chloride between tantalum cathodes and anodes of titanium metal mesh plated with platinum. At the same time, the solution was constantly circulated by pumping. Both the cathodes and anodes had a thickness of 1 mm and were arranged at a distance of 25 mm from one another. The voltage during the electrolysis was 3.5 V, the cathode current density was 265 amp/m$^2$, the bath temperature was 36° to 38° C and the rate of circulation of electrolyte was 430 l/hr.

After reaching a concentration of about 40 g of antimony per liter of electrolyte, the electrolysis was interrupted in order to replace two volume percent of the electrolyte with fresh electrolyte. The electrolyte was concentrated once again to about 140 g Sb/l of electrolyte and the electrolysis was subsequently continued.

The antimony which deposited on the cathode was removed every 48 hours, washed with dilute hydrochloric acid, rinsed with doubly distilled water to neutrality and subsequently dried.

The coarsely grained antimony which was removed by slightly bending the tantalum cathode, contained the following impurities according to spectrographic analysis:

35 ppm sodium
10 ppm chlorine
1 ppm iron
2 ppm lead
0.5 ppm arsenic

Further impurities could not be detected spectrographically.

In order to prepare a bar, the antimony obtained was melted in a graphite crucible under hydrogen at a temperature of 700° – 1000° C. The smelted antimony bar then had the following impurities:

5 ppm Na
2 ppm cl
1 ppm Fe
2 ppm Pb
0.5 ppm As.

What is claimed is:

1. A process for the preparation of high purity antimony comprising:

(a) hydrolyzing antimony(III) chloride with ammonium hydroxide to produce a precipitate of antimony(III) oxide;

(b) dissolving the antimony(III) oxide precipitate in an aqueous solution of d-sorbitol and a base; and (c) subjecting the solution from step (b) to electrolysis using an insoluble anode.

2. The process of claim 1 wherein the anode is titanium metal mesh plated with platinum and the cathode is tantalum.

3. The process of claim 1 wherein the solution in step (c) at the beginning of the electrolysis contains:

about 220 to 270 g of d-sorbitol per liter,
about 80 to 100 g of sodium hydroxide per liter, and
about 130 to 150 g of antimony per liter.

4. The process of claim 1 wherein the electrolysis is carried out at a voltage of about 3 to 5 volts, a cathode density of about 50 to 400 amp/$m^2$ and a bath temperature of about 30° to 50° C and the cathode is about 25 mm from the anode.

5. The process of claim 1 wherein prior to the electrolysis, the solution is heated to about 40° to 70° C, undissolved antimony(III) oxide is filtered off, and wherein during the electrolysis, the solution is circulated.

6. The process of claim 1 wherein the electrolysis is carried out until the antimony concentration of the solution decreases to about 40 g per liter and then about 1 to 3 volume percent of the solution is replaced with fresh solution.

* * * * *